US007096856B2

(12) United States Patent
Fukuhara et al.

(10) Patent No.: US 7,096,856 B2
(45) Date of Patent: Aug. 29, 2006

(54) FUEL FEED PUMP FOR INTERNAL COMBUSTION ENGINES

(75) Inventors: Yusuke Fukuhara, Higashimatsuyama (JP); Nobuo Aoki, Higashimatsuyama (JP); Koji Hatanaka, Higashimatsuyama (JP)

(73) Assignee: Bosch Automotive Systems Corporation, (JP)

( * ) Notice: Subject to any disclaimer, the term of this patent is extended or adjusted under 35 U.S.C. 154(b) by 191 days.

(21) Appl. No.: 10/798,575

(22) Filed: Mar. 12, 2004

(65) Prior Publication Data

US 2004/0173189 A1 Sep. 9, 2004

(30) Foreign Application Priority Data

Mar. 14, 2003 (JP) ..... 2003-070487

(51) Int. Cl.
*F02M 37/08* (2006.01)
*F02M 37/04* (2006.01)

(52) U.S. Cl. ..... 123/496; 123/300

(58) Field of Classification Search ..... 123/495, 123/496, 510, 511, 457, 456; 417/20, 43, 417/300; 137/115.03, 118.04, 119.06, 87.03, 137/459, 486
See application file for complete search history.

(56) References Cited

U.S. PATENT DOCUMENTS 4,227,501 A * 10/1980 Knapp et al. ..... 123/453
4,630,639 A * 12/1986 Akita et al. ..... 137/486
4,813,447 A * 3/1989 Ichiryu et al. ..... 137/486
5,701,869 A * 12/1997 Richardson et al. ..... 123/497
6,289,919 B1 * 9/2001 Sledd et al. ..... 137/115.03
6,352,067 B1 * 3/2002 Genslak ..... 123/510
6,792,918 B1 * 9/2004 Halsall ..... 123/446
6,805,106 B1 * 10/2004 Kumagai et al. ..... 123/514
6,854,445 B1 * 2/2005 Okamoto ..... 123/446
2004/0194762 A1 * 10/2004 Okamoto ..... 123/458

FOREIGN PATENT DOCUMENTS

JP A-8-210210 8/1996

* cited by examiner

*Primary Examiner*—Mahmoud Gimie
(74) *Attorney, Agent, or Firm*—Connolly Bove Lodge & Hutz LLP

(57) ABSTRACT

A fuel feed pump is provided that has a fuel flow-rate regulating valve, on the inlet side. The fuel flow-rate regulating valve includes a housing with a fuel inlet port and a fuel outlet port, a valve mechanism for controlling the flow rate of the fuel from the inlet port to the outlet port, and a regulating mechanism for regulating a backpressure to control the position of a needle valve of the valve mechanism in response to a system pressure, to thereby control the flow rate by controlling the fuel flow through an opening provided in a valve chamber. This arrangement makes it difficult for contamination to accumulate, and also enables a low-cost implementation.

12 Claims, 2 Drawing Sheets

FUEL FEED PUMP FOR INTERNAL COMBUSTION ENGINES

BACKGROUND OF THE INVENTION

1. Field of the Invention

This invention relates to a fuel feed pump for internal combustion engines.

2. Background Art

Various types of feed pump are used as fuel supply pumps of vehicles. Conventionally, such pumps use a configuration that allows the maximum flow rate to be changed in order to make the pumps adaptable to a broad range of specifications. Japanese Public Disclosure No. Hei 8-210210, for example, discloses a feed pump used as the supply pump in a common-rail type fuel-injection pump. In the case of the disclosure, a pressure valve is provided in the bypass passage to make it possible to control the amount of fuel being moved. In accordance with this configuration, during normal operation a large quantity of fuel is fed to a high-pressure pump and fuel movement is suppressed at non-injection times. This makes it possible to prevent a large amount of fuel being wastefully circulated between the fuel pump and the fuel tank.

However, this conventional technology uses a check valve that is opened/closed in response to pressure, making it possible for contamination to occur by foreign matter being drawn onto the valve seat during valve operation, so that when the value is open the flow rate tends to be altered by the contamination. For this reason, control of the flow rate has not been very precise. Another problem has been that of the noise and vibration produced by the seating impact each time the valve opens and closes.

SUMMARY OF THE INVENTION

An object of this invention is therefore to provide a fuel feed pump for internal combustion engines that overcomes the aforesaid shortcomings of the prior art.

Another object of the invention is to provide a fuel feed pump for internal combustion engines in which it is difficult for contaminants to accumulate.

Another object of the invention is to provide a fuel feed pump for internal combustion engines that enables the cost to be reduced.

Another object of the invention is to provide a fuel feed pump for internal combustion engines that is highly reliable.

For achieving these objects, the invention provides a fuel feed pump for internal combustion engines having a fuel flow-rate regulating valve on an inlet side, wherein the fuel flow-rate regulating valve comprises a housing having a fuel inlet port and a fuel outlet port, a valve mechanism for controlling a flow rate of fuel from the fuel inlet port to the fuel outlet port, said valve mechanism being equipped in the housing, and a regulating mechanism for regulating a back-pressure to regulate a position of a valve element of the valve mechanism in response to a system pressure. The valve element can be a needle valve. The valve mechanism can have a configuration comprising a chamber that operably accommodates the valve element and an opening provided in the chamber that communicates with the fuel inlet port, in which the valve element controls the fuel flow rate by controlling the flow rate of fuel in the opening.

If a needle valve is used as the valve element, the valve mechanism can have a configuration comprising a chamber that operably accommodates the valve element and an opening provided in the chamber that communicates with the fuel inlet port, in which a valve seat formed on an edge portion of the opening and the valve element cooperate to control the flow rate of the fuel.

The regulating mechanism can have a configuration in which means are provided that resiliently urges the valve element in a valve-open direction, and a fuel discharge acts on the valve element to restrain the valve element in the valve-open direction.

The invention will be better understood and other objects and advantages thereof will be more apparent from the following detailed description of preferred embodiments with reference to the accompanying drawings.

DETAILED DESCRIPTION OF THE PREFERRED EMBODIMENT

Details of an embodiment of the invention will now be described with reference to the drawings.

Figure 1:
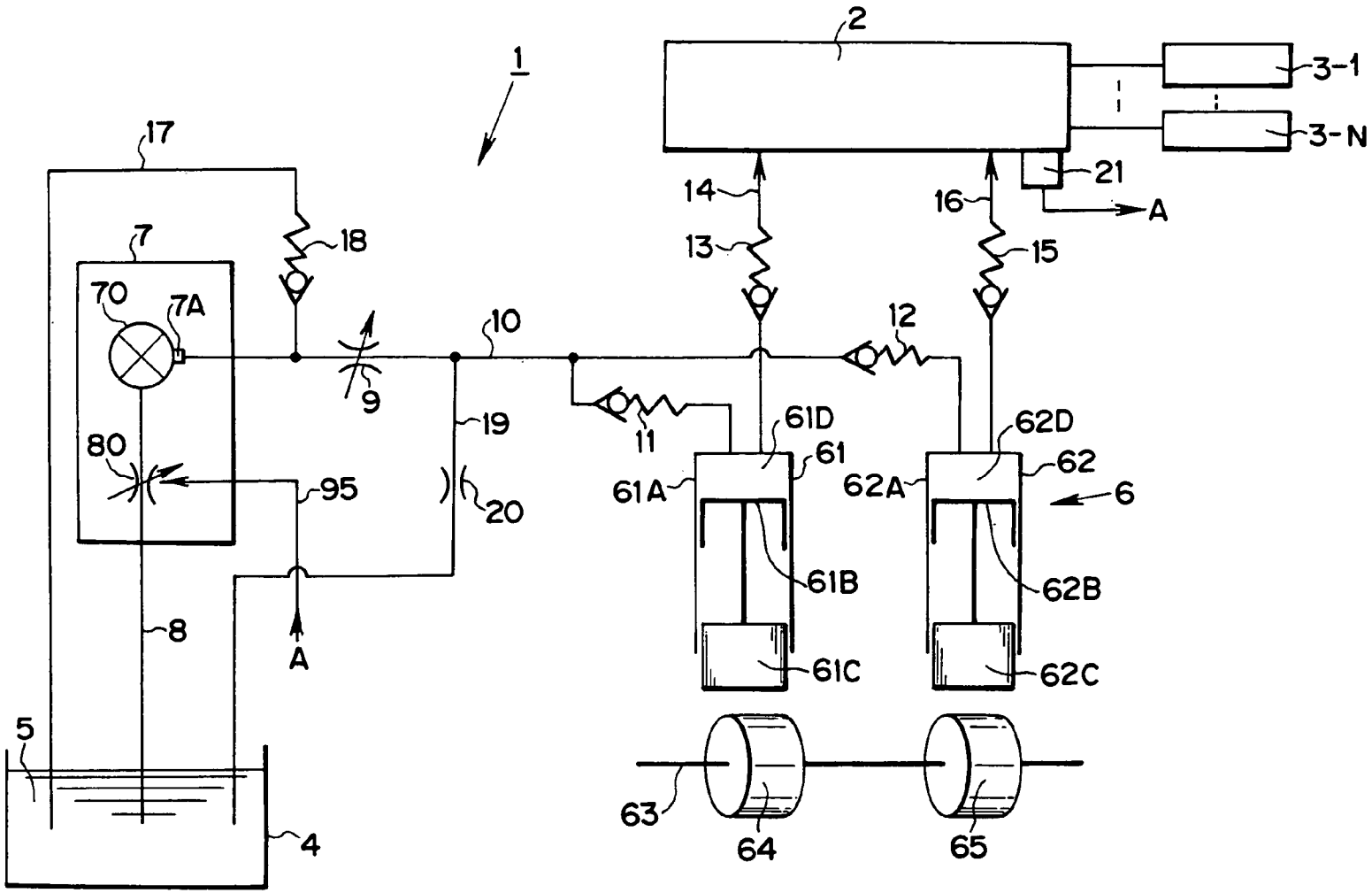
FIG. 1 is a general schematic diagram of an embodiment of the invention.

FIG. 1 is a general schematic diagram of an embodiment of the invention.

With reference to FIG. 1, a fuel injection apparatus 1 is configured as a common rail type fuel injection apparatus in which high-pressure fuel stored in a common rail 2 is injected into the cylinders (not shown) of an internal combustion engine by injectors 3-1 to 3-N. The common rail 2 is provided with a pressure regulation valve 21 for regulating the pressure of the fuel in the common rail 2 to a prescribed pressure. The injectors 3-1 to 3-N are each provided for a corresponding cylinder, and are operated under the control of an injection control unit (not shown) configured using a microcomputer.

In, the FIG. 1, reference numeral 4 denotes a reservoir and 6 a high-pressure pump. Reference numeral 7 denotes a fuel feed pump 7 according to this invention, provided as a low-pressure feed pump on the low-pressure side of the high-pressure pump 6. Fuel 5 in the reservoir 4 is drawn up, via fuel pipe 8, by the fuel feed pump 7, and delivered as low-pressure fuel from outlet port 7A of the fuel feed pump 7. The low-pressure fuel is delivered to the high-pressure pump 6, via a fuel feed pipe 10 that is provided with a fuel flow rate control valve 9 for regulating the flow of fuel to the high-pressure pump 6, via suction valves 11 and 12.

In this embodiment, the high-pressure pump 6 has two high-pressure plungers, 61 and 62, which are driven by cams 64 and 65 affixed to a camshaft 63 that is rotated by a rotational force from an internal combustion engine that is not shown.

The high-pressure plunger 61 comprises a piston 61B housed in a cylinder 61A, with the piston 61B able to move reciprocally along the axis of the cylinder 61A. The reciprocating movement of the piston 61B is driven by the rotation of the cam 64 against tappet 61C. Via the suction valve 11, low-pressure fuel is supplied to a plunger chamber 61D, where it is pressurized by the piston 61B. The high-pressure fuel thus obtained is fed into the common rail 2 via an injection line 14 that has a check valve 13 that opens in the direction of the common rail 2.

The high-pressure plunger 62 has the same configuration as the high-pressure plunger 61. That is, the high-pressure plunger 62 comprises a piston 62B housed in a cylinder 62A, with the piston 62B able to move reciprocally along the axis of the cylinder 62A, with the reciprocating movement of the piston 62B being driven by the rotation of the cam 65 against tappet 62C. Via the suction valve 12, low-pressure fuel is supplied to a plunger chamber 62D, where it is pressurized by the piston 62B, and the high-pressure fuel thus obtained is fed into the common rail 2 via an injection line 16 that has a check valve 15 that opens in the direction of the common rail 2.

In order to return to the reservoir 4 fuel backflow produced by the operation of the fuel flow rate control valve 9, a return channel 17 is provided between the outlet port 7A of the fuel feed pump 7 and the reservoir 4. The return channel 17 has a check valve 18 that opens in the direction of the reservoir 4. The portion of the low-pressure fuel discharged from the feed pump 7 that does not go to the high-pressure pump 6, due to the fuel flow rate control valve 9, is returned to the reservoir 4 via the return channel 17.

To improve the non-injection control characteristics of the high-pressure pump 6 of the fuel injection apparatus 1, a return channel 19 is also provided on the outlet side of the fuel flow rate control valve 9. As a result, any fuel leakage from the fuel flow rate control valve 9 that may occur when the fuel flow rate control valve 9 is closed during non-injection control of the high-pressure pump 6 is returned to the reservoir 4 via a zero delivery orifice 20 provided in the return channel 19.

The feed pump 7 has a pump body 70, and a fuel flow-rate regulating valve 80 provided on the fuel outlet side of the pump body 70.

Figure 2:
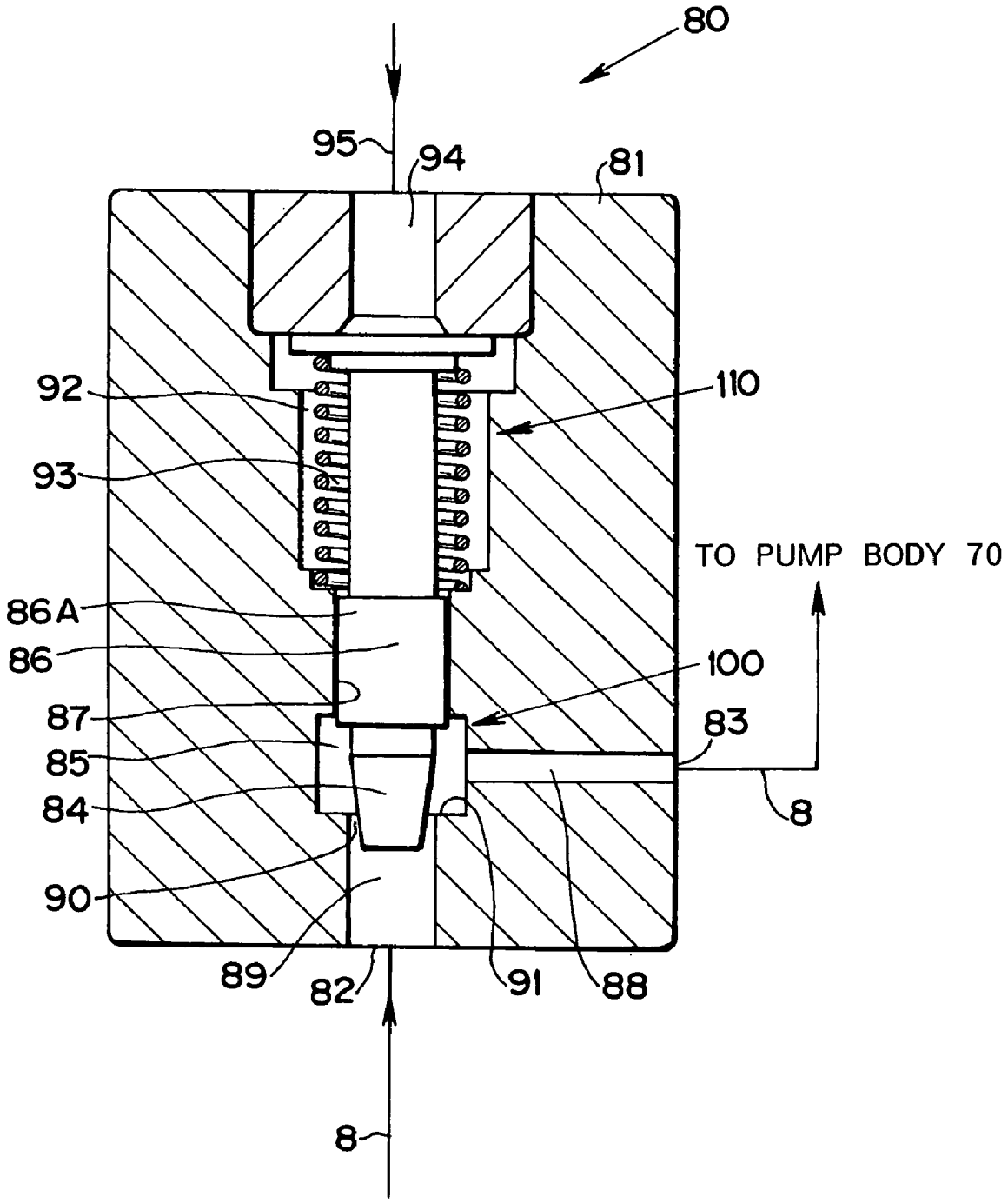
FIG. 2 is an enlarged cross-sectional view of the fuel flow-rate regulating valve shown in FIG. 1.

FIG. 2 is a detailed cross-sectional view of the flow-rate regulating valve 80. The flow-rate regulating valve 80 has a housing 81, which has an inlet port 82 through which fuel 5 from the reservoir 4 is received via the fuel pipe 8, and an outlet port 83 via which flow-rate-regulated fuel is delivered to the pump body 70. The housing 81 also has a chamber 85 formed therein that operably accommodates a needle valve 84.

A stepped guide rod 86 is affixed to the rear end of the needle valve 84, to be coaxial therewith. A guide-hole 87 is formed in a chamber 85. The guide rod 86 is movably supported in the guide-hole 87 by a large-diameter portion 86A, so that the guide rod 86 can move freely along the axis thereof.

The chamber 85 communicates with the outlet port 83 via a channel 88 formed in the housing 81. One end of a channel 89 that extends from the inlet port 82 opens into the chamber 85. In this embodiment, the channel 89 is formed concentrically with the needle valve 84. The opening 90 of the channel 89 is formed into a valve seat 91.

The needle valve 84 has a conical tip that tapers down towards the tip, forming a valve mechanism 100 in which the flow rate of fuel flowing into the inlet port 82 and out of the outlet port 83 can be regulated according to the degree by which the tip of the needle valve 84 is inserted into the opening 90.

The needle valve 84 is urged away from the valve seat 91 by a compressed coil spring 93 disposed in a spring chamber 92 provided behind the guide-hole 87.

The housing 81 has a pressure introduction port 94 in communication with the spring chamber 92. The system pressure of the fuel injection apparatus acts on the pressure introduction port 94 via a pipe 95. In this embodiment, pressure generated in the return line to the reservoir, on the downstream side of the common-rail pressure regulation valve 21, is utilized as the system pressure (see FIG. 1). In this way, the system pressure of the fuel injection apparatus 1 is introduced into the pressure introduction port 94 and applied as backpressure to the needle valve 84, so that the needle valve 84 is positioned at a point at which the forces of the system pressure and the compressed coil spring 93 are in balance. As a result, the degree of opening of the valve mechanism 100 is set according to the delivery pressure of the fuel.

With the flow-rate regulating valve 80 thus configured, when a large quantity of fuel is flowing through the flow rate control valve 9 to the system because not enough fuel is being discharged from the pump body 70, the opening of the valve mechanism 100 increases, increasing the amount of fuel delivered to the pump body 70. On the other hand, if a small quantity of fuel is flowing through the flow rate control valve 9 because there is an overflow of fuel from the pump body 70, the opening of the valve mechanism 100 decreases, reducing the amount of fuel delivered to the pump body 70.

As a result, in response to the system pressure, just the required amount of fuel is supplied to the feed pump 7, effectively preventing wasteful circulation of fuel between the feed pump 7 and the reservoir 4.

The flow-rate regulating valve 80 has a regulating mechanism 110 disposed concentrically with the valve mechanism 100. The regulating mechanism 110 includes the spring chamber 92, compressed coil spring 93 and pressure introduction port 94, and is for regulating the backpressure to adjust the position of the needle valve 84 of the valve mechanism 100 in accordance with the system pressure. Since the holes are all disposed concentrically, processing is simple, and both processing and assembly can be accomplished at low cost.

Also, since the needle valve 84 is used to regulate the fuel flow rate, the state of the spacing between the needle valve 84 and the valve seat 91 is constantly changing, making it difficult for dirt and other such contaminants to accumulate. There is therefore almost no risk of flow rate control being hindered by contaminants or the like, so the flow rate can be controlled with very high reliability.

Moreover, in accordance with the valve mechanism 100 shown in FIG. 2, any fuel that might leak after the needle valve 84 is seated on the valve seat 91 will always leak towards the fuel inlet.

Thus, the flow-rate regulating valve 80 is configured so that the fuel flow area can be continuously changed by moving the tapered tip portion of the needle valve 84. Since there is no sliding between the needle valve 84 and the valve seat 91, such as in the case of a spool valve, contamination-resistance is improved. As a result, in high-pressure pumps used for high flow-rate Amplified Piston Common Rail System (APCRS) applications, it is possible to use the feed pump 7 with a variable-throttle function without worrying about contaminants accumulating.

Moreover, ideal opening characteristics can be readily set by changing the shape of the tapered tip of the needle valve 84, making the invention superior to the prior art in terms of function and processing.

The above explanation of the invention has been made with respect to its application to the fuel feed pump of a fuel injection apparatus. However, the invention is not limited to the embodiment shown, but may be similarly applied to fuel feed pumps for other purposes, with the same effect.

In accordance with this invention, a fuel feed pump for internal combustion engines is provided that has high reliability with excellent contamination-resistance.

What is claimed is:

1. A fuel feed pump for internal combustion engines having a fuel flow-rate regulating valve on an inlet side, wherein the fuel flow-rate regulating valve comprises:

a housing having a fuel inlet port and a fuel outlet port, a valve mechanism equipped in the housing for controlling a flow rate of fuel from the fuel inlet port to the fuel outlet port, wherein said valve mechanism includes a chamber that operably accommodates a needle valve having a conical tip that tapers down toward an end of the tip, wherein said chamber includes an opening that communicates with the fuel inlet port; and a regulating mechanism for regulating a backpressure to regulate a position of the needle valve in response to a system pressure, wherein the needle valve controls the flow rate of fuel from the fuel inlet port to the fuel outlet port by controlling a flow rate of fuel in the opening.

2. A fuel feed pump as claimed in claim 1, wherein a valve seat formed on an edge portion of the opening and the needle valve cooperate to control the flow rate of the fuel in the opening.

3. A fuel feed pump as claimed in claim 1, wherein the backpressure regulating means includes means that resiliently urges the needle valve in a valve-open direction, and a discharged fuel acts on the needle valve to restrain the needle valve in the valve-open direction.

4. A fuel feed pump as claimed in claim 1, wherein a stepped guide rod is affixed to a rear end of the needle valve so as to be coaxial with the needle valve.

5. A fuel feed pump as claimed in claim 4, wherein a guide hole is fanned in the chamber.

6. A fuel feed pump as claimed in claim 4, wherein the guide rod is movably supported in the guide hole by a large-diameter portion.

7. A fuel feed pump as claimed in claim 1, wherein the needle valve is formed concentrically with a channel.

8. A fuel feed pump as claimed in claim 2, wherein the backpressure regulating means includes means that resiliently urges the needle valve in a valve-open direction, and a discharged fuel acts on the needle valve to restrain the needle valve in the valve-open direction.

9. A fuel feed pump as claimed in claim 4, wherein the backpressure regulating means includes means that resiliently urges the needle valve in a valve-open direction, and a discharged fuel acts on the needle valve to restrain the needle valve in the valve-open direction.

10. A fuel feed pump as claimed in claim 5, wherein the backpressure regulating means includes means that resiliently urges the needle valve in a valve-open direction, and a discharged fuel acts on the needle valve to restrain the needle valve in the valve-open direction.

11. A fuel feed pump as claimed in claim 6, wherein the backpressure regulating means includes means that resiliently urges the needle valve in a valve-open direction, and a discharged fuel acts on the needle valve to restrain the needle valve in the valve-open direction.

12. A fuel feed pump as claimed in claim 7, wherein the backpressure regulating means includes means that resiliently urges the needle valve in a valve-open direction, and a discharged fuel acts on the needle valve to restrain the needle valve in the valve-open direction.

* * * * *